US008555867B2

(12) United States Patent
Srinivasan et al.

(10) Patent No.: US 8,555,867 B2
(45) Date of Patent: Oct. 15, 2013

(54) ENERGY EFFICIENT PLASMA GENERATION

(76) Inventors: Arvind Srinivasan, Seattle, WA (US); Karthikeyan Ramanathan, Baton Rouge, LA (US); Luc Choquette, Gatineau (CA); Aaron Murakami, Spokane, WA (US)

( * ) Notice: Subject to any disclaimer, the term of this patent is extended or adjusted under 35 U.S.C. 154(b) by 623 days.

(21) Appl. No.: 12/819,146

(22) Filed: Jun. 18, 2010

(65) Prior Publication Data

US 2010/0319644 A1 Dec. 23, 2010

Related U.S. Application Data

(60) Provisional application No. 61/218,351, filed on Jun. 18, 2009, provisional application No. 61/260,290, filed on Nov. 11, 2009, provisional application No. 61/311,866, filed on Mar. 9, 2010.

(51) Int. Cl.
*F02P 3/02* (2006.01)

(52) U.S. Cl.
USPC ..... 123/620; 123/605; 123/628

(58) Field of Classification Search
USPC ..... 123/620, 596, 605, 609, 62, 628, 653; 73/114.67; 324/378, 388, 399
See application file for complete search history.

(56) References Cited

U.S. PATENT DOCUMENTS

| | | | | |
|---|---|---|---|---|
| 3,788,293 | A | 1/1974 | Anderson | |
| 3,945,362 | A * | 3/1976 | Neuman et al. | 123/606 |
| 4,029,072 | A | 6/1977 | Goto et al. | |
| 4,223,656 | A | 9/1980 | Hamley | |
| 4,366,801 | A | 1/1983 | Endo et al. | |
| 4,369,756 | A | 1/1983 | Ezoe | |
| 4,619,241 | A | 10/1986 | Yoshinari | |
| 4,996,967 | A | 3/1991 | Rosswurm et al. | |
| 5,197,448 | A | 3/1993 | Porreca et al. | |
| 5,321,978 | A | 6/1994 | Brandt et al. | |
| 5,777,216 | A | 7/1998 | Van Duyne et al. | |
| 6,553,981 | B1 | 4/2003 | Suckewer et al. | |
| 6,883,509 | B2 * | 4/2005 | Porter et al. | 123/647 |
| 6,922,057 | B2 * | 7/2005 | Zhu et al. | 324/382 |
| 6,951,201 | B2 * | 10/2005 | Zhu et al. | 123/406.27 |
| 7,055,372 | B2 * | 6/2006 | Daniels et al. | 73/35.08 |
| 7,063,079 | B2 * | 6/2006 | Huberts et al. | 123/630 |
| 7,137,382 | B2 * | 11/2006 | Zhu et al. | 123/435 |
| 7,137,385 | B2 * | 11/2006 | Newton | 123/630 |

OTHER PUBLICATIONS

Miyata, et al., "Flame Ion Density Measurement Using Spark Plug Voltage Analysis," SAE Technical Paper 930462, Mar. 1, 1993.

* cited by examiner

*Primary Examiner* — John Kwon

(57) ABSTRACT

A plasma ignition system is described herein that can produce plasma ionization around a spark plug gap using a single power circuit for the spark and plasma ionization. The system results in fewer components and higher reliability, allowing the system to be more easily integrated with existing ignition circuitry or in new ignition system designs. The plasma ignition system adds a one-way current path between the primary and secondary windings of the high voltage transformer. This allows energy stored within the capacitor after the creation of the spark to flow out of the capacitor, across the one-way current path, and through the spark plug gap. Thus, the plasma ignition system provides a dramatically better ignition spark with relatively little increase in components. The system does so without requiring a secondary power supply circuit to generate the current for producing plasma ionization.

19 Claims, 5 Drawing Sheets

ENERGY EFFICIENT PLASMA GENERATION

CROSS-REFERENCE TO RELATED APPLICATIONS

The present application claims the benefit of the following U.S. provisional patent applications: No. 61/218,351 entitled "METHOD AND APPARATUS FOR GENERATING A HIGH CURRENT PLASMA ARC USING A SINGLE MODE CAPACITOR DISCHARGE IGNITION SYSTEM," and filed on Jun. 18, 2009; No. 61/260,290 entitled "IONIZATION DETECTION USING A SINGLE MODE HIGH ENERGY CAPACITOR DISCHARGE IGNITION SYSTEM," and filed on Nov. 11, 2009; and No. 61/311,866 entitled "COIL ON PLUG ADAPTATION FOR DUAL ENERGY IGNITION SYSTEMS," and filed on Mar. 9, 2010, which are each hereby incorporated by reference.

BACKGROUND

Internal combustion engines generally operate by compressing a fuel and air mixture then firing a spark that ignites the mixture to produce the controlled explosion that powers the engine. The spark is typically produced by sending a high voltage to a spark plug that has a specified gap size. The high voltage causes electrons to jump across the gap, and the resulting spark ignites the fuel. The efficiency and pollution characteristics of an internal combustion engine are determined in part by the completeness of burning the fuel. If an engine does not burn all of the fuel or fails to produce a spark so that none of the fuel is burned, the unburned fuel is expelled as exhaust from the vehicle using the internal combustion engine. Whether an engine completely burns the fuel is determined in part by the robustness of the spark. Years of research have gone into creating ever more durable and reliable spark generation systems to ensure reliable spark production. Modern ignition systems typically include platinum tipped spark plugs that can reliably produce a spark for 100,000 miles or more.

One area of research that has dramatically improved spark performance is the production of plasma at the spark gap of the spark plug. Plasma is ionization of the air around the gap to a point where the spark is no longer just between the two electrodes on either side of the spark plug gap, but is also in a ball of charge surrounding the gap. This larger spark produces a more complete burning of the fuel, and leads to more power and efficiency from the engine. While a spark is produced by high voltage that causes electrons to jump the spark plug gap, a plasma ionization is produced by feeding high current across the spark plug gap. Although a spark plug gap is initially an open circuit, once the spark crosses the gap the gap is a similar conductor to a wire, and a high current fed to the gap after the initial spark will result in plasma ionization.

Although typical ignition systems are good at generating high voltage, they are not typically designed to produce high current. Current plasma ignition systems therefore typically include a second power supply circuit that feeds the current used for plasma ionization. While the combined circuitry produces a much better spark, the increase in components and cost is a disadvantage of such dual energy ignition systems. A typical plasma ignition system includes two isolated DC-DC convert circuits the first DC DC converter circuit is a high voltage transformer that converts 12 VDC battery supply to generate a 20 to 80 KV ignition spark that ignites the fuel and the second DC DC converter, converts 12V DC battery to charge a 600V capacitor that discharges the follow on current to increase the energy of the ignition spark generated by the first DC DC converter circuit. This method results in additional components that increase the cost of the system and increase breakdown risk. In addition, modern ignition systems have moved to a coil-on-plug (COP) system that includes the traditional coil of a primary ignition system on top of the spark plug itself, to reduce radio frequency (RF) interference to other components of the vehicle and to reduce power loss inherent in transmitting a high voltage over a greater distance. For COP systems, it is difficult to fit a second power supply for high energy plasma ionization on top of the plug with the other electronics.

DETAILED DESCRIPTION

Figure 1:
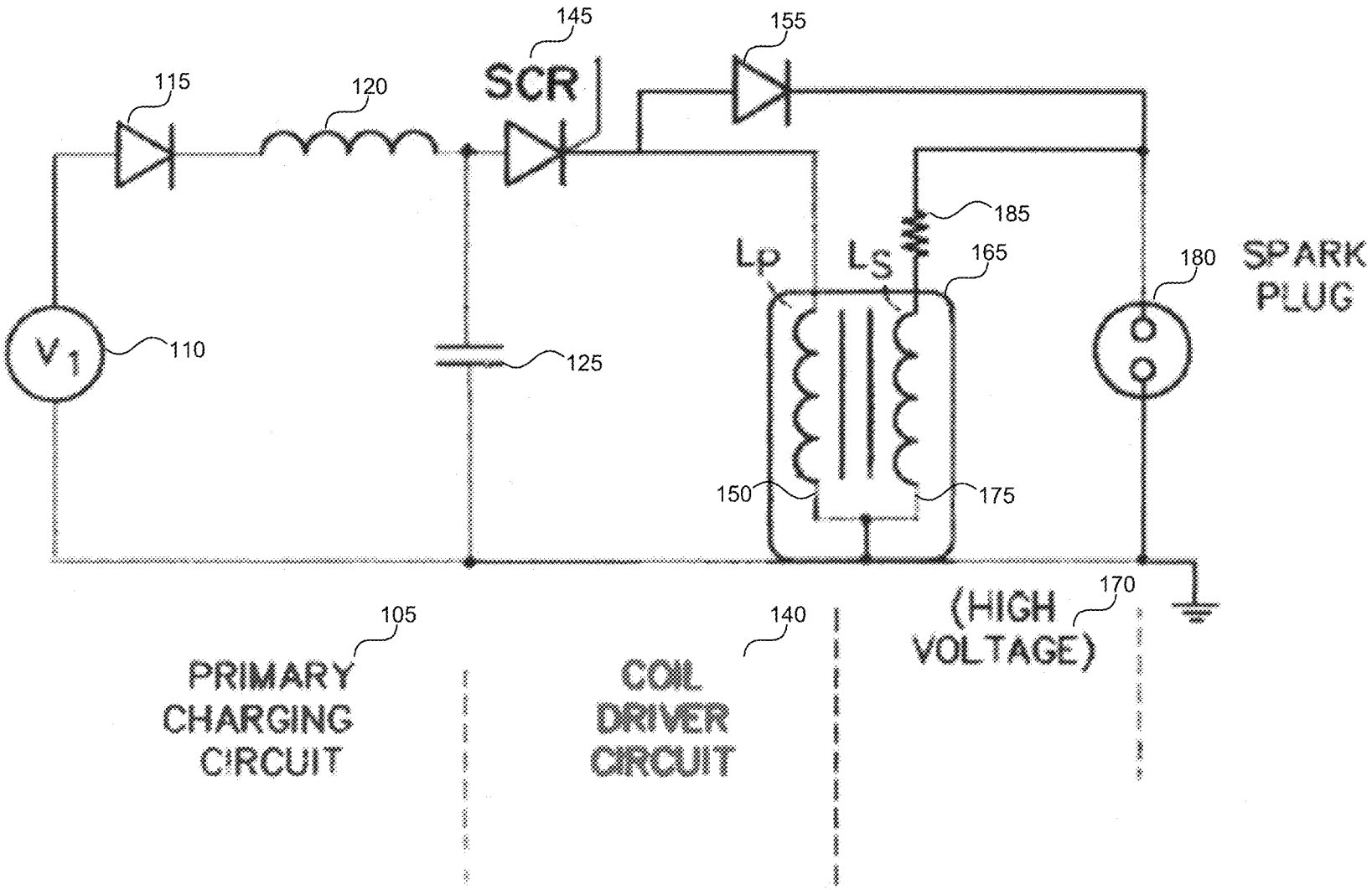
FIG. 1 is a circuit diagram that graphically illustrates the components of the plasma ignition system, in one embodiment.

A plasma ignition system is described herein that can produce high energy plasma ionization around a spark plug gap using a single power circuit for the spark and high energy plasma ionization. The system results in fewer components and higher reliability, allowing the system to be more easily integrated with existing ignition circuitry or in new ignition system designs.

A conventional ignition system typically provides a single high voltage capable of causing a discharge between the two electrodes of a conventional spark plug. Common systems for providing such a high voltage include transistorized coil ignition (TCI) and capacitive discharge ignition (CDI) systems. These systems are effective in providing the high voltage for the initial discharge. Capacitor discharge ignition systems generally employ a discharge capacitor that is alternatively connected between a source of direct current and the primary winding of a high voltage transformer having its secondary winding connected to the ignition device (e.g., a spark plug). The capacitor in such systems may receive direct current from a storage device or from a coil disposed in flux-cutting proximity to a magnetic element movable in response to rotation of the engine. The switch means customarily employed to alternatively connect the capacitor to the source of direct current and to the primary winding of the high voltage transformer may be of solid state type, e.g., a silicon controlled rectifier or a thyristor, and operable in response to engine rotation by means of a trigger coil disposed in flux-cutting proximity to the same magnetic element as the current source. Alternatively, the switch may be breaker points mechanically operable in response to engine rotation in a conventional manner. In applications that are more modern this signal may emanate from a vehicle's onboard Engine Control Unit (ECU) in the form of a voltage high/low indicator.

Current capacitor discharge ignition systems suffer from the disadvantage that all of the energy in the capacitor is applied to the ignition device through the high voltage transformer. While the impedance of the primary side of said high voltage transformer is generally quite small upon the initial application of the discharge pulse, the impedance of the high voltage transformer becomes quite large as the passage of current through the windings of the transformer is sustained. The impedance of the high voltage transformer thus significantly reduces the potential applied to the ignition device and increases losses in the system yielding poor conversion of the input energy at the spark.

The plasma ignition system adds a one-way current path between the primary and secondary windings of the high voltage transformer. Before a spark has occurred, the spark plug gap is electrically an open circuit. The one-way current path between the primary and secondary sides of the transformer thus has little effect. Upon generation of a spark, however, the spark plug gap becomes electrically like a low resistance wire, completing a path to ground. This allows energy stored within the capacitor after the creation of the spark to flow out of the capacitor, across the one-way current path, and through the spark plug gap. Even though the voltage of the capacitor is small compared to that produced by the secondary windings of the transformer, the current produced through the spark plug gap can be quite large due to Ohm's Law and the low resistance of the completed circuit of the spark plug gap. This high current produces ionization of the air around the spark plug gap, thus resulting in plasma generation and a more effective higher energy spark. In addition, the circuit is very efficient because it utilizes energy already stored in the capacitor that would be wasted dissipating across the primary windings of the transformer in prior ignition systems. Thus, the single mode plasma ignition system provides a dramatically better higher energy ignition spark with relatively little increase in components. The system does so without requiring a secondary power supply circuit to generate the current for producing plasma ionization.

Because the current path is one-way, a high voltage blocking element protects the capacitor from the high voltage discharge from the secondary of the high voltage transformer. The high voltage high current plasma flow across the spark gap generated by this method is suitable for all fuel combustion applications such as in internal combustion engines, industrial boilers, fuel stacks, and so forth.

FIG. 1 is a circuit diagram that graphically illustrates the components of the single mode plasma ignition system, in one embodiment. Although individual components are described, it will be appreciated by those skilled in the art that various components can be replaced by other components or multiple components providing substantially the same function for various reasons (e.g., because a particular component is more readily available at lower cost or has other desirable characteristics). The circuit of FIG. 1 includes a primary charging circuit 105, a coil driver circuit 140, and an ignition circuit 170.

The primary charging circuit 105 provides the voltage and current to the primary side of an ignition coil causing the secondary side to discharge spark and plasma. The primary charging circuit 105 includes a voltage supply 110, a blocking diode 115, an inductive element 120, and a capacitor 125. The voltage supply 110 charges the capacitor 125. The coil driver circuit 140 includes the capacitor 125, a silicon-controlled rectifier 145 (SCR), the primary side 150 of a high-voltage transformer 165 (e.g., an ignition coil), and a high voltage blocking element 155. The silicon-controlled rectifier 145 provides a switching mechanism that can be triggered by an external signal to discharge the capacitor 125 into the primary side 150 of the ignition coil. For example, the ECU of an engine may trigger the silicon-controlled rectifier to cause ignition in a particular engine cylinder.

The ignition circuit 170 includes the secondary side 175 of the high-voltage transformer and a spark plug or other ignition device 180. Upon the initial application of the discharge pulse (e.g., caused by signaling of the SCR), the impedance of the high voltage transformer 165 becomes quite large as the passage of current through the windings of the transformer is sustained. The impedance of the high voltage transformer 165, ensures that the capacitor 125 drains at a slow enough rate that a secondary parallel path protected by a high voltage blocking element 155, that connects the output of the Capacitor 125, directly to the spark gap 180 allows for the remaining energy in the capacitor to directly discharge across the initial plasma arc even though the capacitor is at a lower voltage than the secondary output of the high voltage transformer. This current expands the plasma kernel thereby increasing spark energy, ionizing more gas (air/fuel mixture) and ensuring complete combustion.

Most vehicles use a negative voltage ignition system rather than a positive one, and those of ordinary skill in the art will recognize that the circuit of FIG. 1 can operate in both cases. Having the spark jump from a hotter surface to a colder surface typically produces better ignition and may improve the wear patter of the spark plug. By using a negative voltage, the system can ensure that the spark jumps from the center electrode of the spark plug to ground. The voltage can be reversed to have the spark jump in the opposite direction. In a negative voltage ignition system, the blocking element 155 can be reversed and placed between the ground side of the spark plug 180 and the lower side of the capacitor 125.

The coil driver circuit 140 and ignition circuit 170 can be replicated for as many cylinders as there are in an engine. In most engines, a single primary charging circuit 105 and capacitor 125 are used to supply discharge power for the spark in each cylinder. A silicon-controlled rectifier 145 for each cylinder is signaled (e.g., by an ECU) upon ignition time for that cylinder. Each cylinder can have a high blocking element 155 that allows excess current from the capacitor 125 to flow across the spark plug gap producing plasma ionization. Once the conducting path has been established across the spark gap 180 by the initial spark, the capacitor 125 quickly discharges its remaining charge through the parallel path protected by the high voltage blocking element 155 directly across the spark gap 180, providing a high power input, or current, into the initial plasma arc. The blocking element 155 (or elements) electrically isolates the ignition coil 165 secondary side 175 from the capacitor 125 preventing reverse current flow. Without the high voltage blocking element 155, the high voltage output of the secondary side 175 would ground itself through the capacitor 125 and the conventional high voltage spark across the spark gap 180 would not occur, preventing ignition. In some embodiments, the plurality of silicon-controlled rectifiers 145, ignition coils 165, and high voltage blocking elements 155 (for each cylinder) are mounted as a coil over plug assembly for use in internal combustion engines. This ensures that the energy stored in the capacitor 125 is available to produce high-energy plasma at any of the individual spark plugs 180 by the appropriate triggering of its associated silicon-controlled rectifier 145 switching control device.

In some embodiments, the system includes a resistor 185 that suppresses radio frequency interference from the ignition coil 165 and to prevent a low resistance current path between the voltage source 110 and the spark gap 180. The resistor 185 may also be replaced by a diode that prevents current from flow from the blocking element 155 through the secondary side 175 of the high voltage transformer 165. This variation also allows the high voltage blocking element 155 to be connected before the silicon-controlled rectifier 145 (e.g., directly to the capacitor 125). This may be useful, for example, where the system is added to an existing ignition system, and a connection before the silicon-controlled rectifier 145 is more readily accessible than a connection after. Because the spark gap is initially an electrical open circuit and the path through the secondary side 175 is blocked by a diode or other blocking element, no current will flow through the high voltage blocking element 155 until the spark occurs, thereby bridging the spark gap and completing a circuit.

The follow on current that expands the plasma kernel is supplied by the same capacitor that also discharges across the primary side 150 of the ignition coil 165 that generates the initial plasma channel across the spark gap 180. Prior systems are not able to produce a plasma channel with a single input power supply system. Using a single power supply system results in more efficient plasma generation with lower cost and fewer components. The system also limits losses due to mutual induction and reactive impedance. In some embodiments, the circuit includes a second or more circuit(s) coupled to the primary circuit that provides an additional follow on current pulse across the spark gap 180 and causes the plasma kernel to further grow coupled with the follow on current. The circuit of this embodiment may also include a second capacitor coupled in parallel with the spark gap 180 across the secondary side 175 of the high voltage transformer 165.

Figure 2:
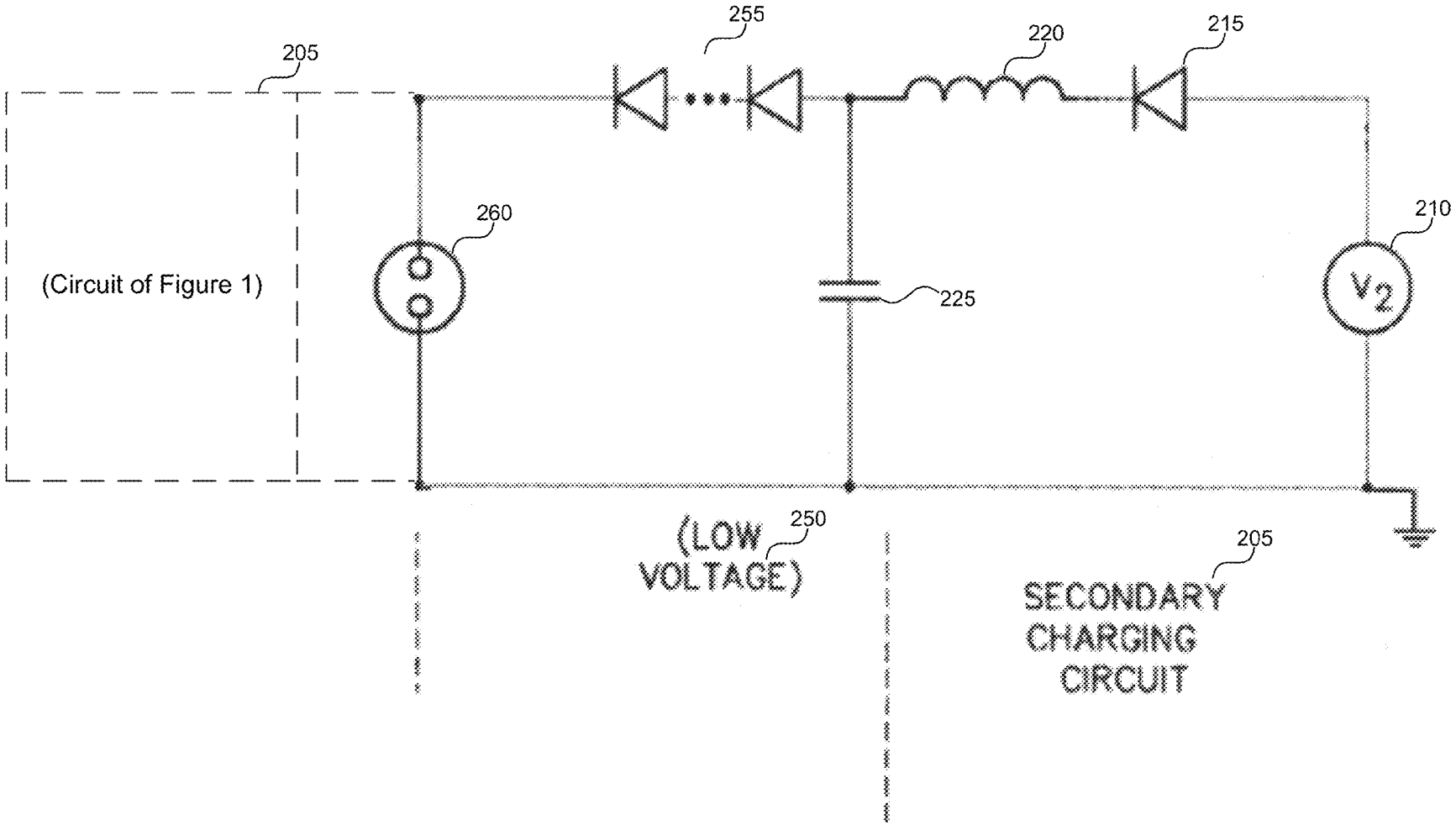
FIG. 2 is a circuit diagram that graphically illustrates components of a secondary support circuit for the plasma ignition system, in one embodiment.

FIG. 2 is a circuit diagram that graphically illustrates components of a secondary support circuit for the plasma ignition system, in one embodiment. Although the circuit of FIG. 1 can operate alone to produce plasma ionization around a spark gap, sometimes it is useful to use a secondary circuit to boost the plasma ionization. In some cases, a manufacturer may already include plasma ionization through a secondary circuit on a vehicle, and an aftermarket vendor may provide an add-on component that allows the primary circuit to operate more efficiently and contribute to the plasma ionization. FIG. 2 includes the circuit 290 of FIG. 1, plus a secondary charging circuit 205, and a low voltage discharge circuit 250. The secondary charging circuit 205 (similar to the primary charging circuit of FIG. 1) includes a voltage supply 210, a blocking diode 215, an inductive element 220, and a capacitor 225. The voltage supply 210 charges the capacitor 225.

The low voltage discharge circuit 250 includes the capacitor 225, one or more diodes 255, and an ignition device 260 (e.g., a spark plug). The ignition device 260 is the same as the spark plug 180 of FIG. 1. One the primary circuit creates a spark that bridges the spark gap 210, the secondary support circuit produces an additional follow on current that grows a plasma kernel surrounding the spark. The voltage of the secondary circuit can be adjusted to produce a greater or lesser plasma kernel, and in some embodiments may be modified dynamically by an ECU or other monitoring circuit to produce particular ignition characteristics within the engine. The robustness of the ignition spark can affect timing and other characteristics of the engine, and the ECU or other monitoring circuit may modify the plasma-producing current along with other engine characteristics to produce particular engine behavior (e.g., better fuel economy, avoid knocking, and so on).

Figure 3:
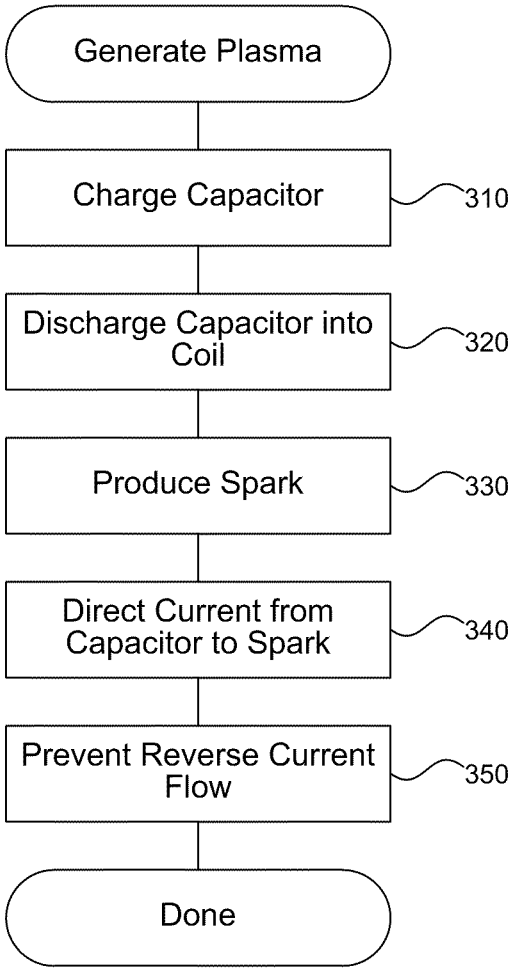
FIG. 3 is a flow diagram that illustrates processing of the plasma ignition system to generate plasma ionization, in one embodiment.

FIG. 3 is a flow diagram that illustrates processing of the plasma ignition system to generate plasma ionization, in one embodiment. Beginning in block 310, the system charges an energy storage device with a charge for creating a spark. For example, a system may include a power supply that charges a capacitor that stores charge for discharging into an ignition circuit at an appropriate time. The spark may be used to ignite a fuel/air mixture in an internal combustion engine.

Continuing in block 320, the system discharges the energy storage device into a high voltage conversion device that converts a first voltage of the energy storage device into a second higher voltage suitable for ionizing air between a spark gap. For example, the system may discharge the capacitor into a high voltage transformer or coil that converts the applied voltage (e.g., hundreds of volts) to a higher voltage (e.g., thousands of volts) to create a spark. In some embodiments, the discharge is controlled by a timing device that produces the spark at an appropriate time based on a mechanical state of an engine (e.g., the degree of rotation of a crankshaft and the state of one or more valves in a four-cycle engine).

Continuing in block 330, the system produces a spark across the spark gap by generating sufficient voltage at the spark gap to cause one or more electrons to jump across the gap. The voltage created by the high voltage transformer quickly reaches a level to bridge the spark gap with a spark. The spark gap may include a spark plug with a gap determined to produce an appropriate spark for igniting a combustible substance.

Continuing in block 340, the system directs remaining energy in the energy storage device across the spark gap without passing through the high voltage conversion device to create a current through the spark gap that causes air to ionize and generate a greater spark. For example, the system may connect the capacitor to the spark gap with a diode that allows current to flow across the spark gap once the initial spark has turned the spark gap from an open circuit to a completed circuit across which current can more easily flow. In some embodiments, the system may also direct a secondary energy supply across the spark gap to produce an enhanced ionization field around the spark gap, thereby producing a greater spark and more robust combustion of fuel near the spark gap.

Continuing in block 350, the system prevents a reverse flow of current from the high voltage conversion device from flowing through the energy storage device. For example, a diode connected between the capacitor and spark gap will allow current to flow in one direction from the capacitor through the spark gap, but not in the reverse direction back to the capacitor or power supply. After block 350, these steps conclude.

Figure 4:
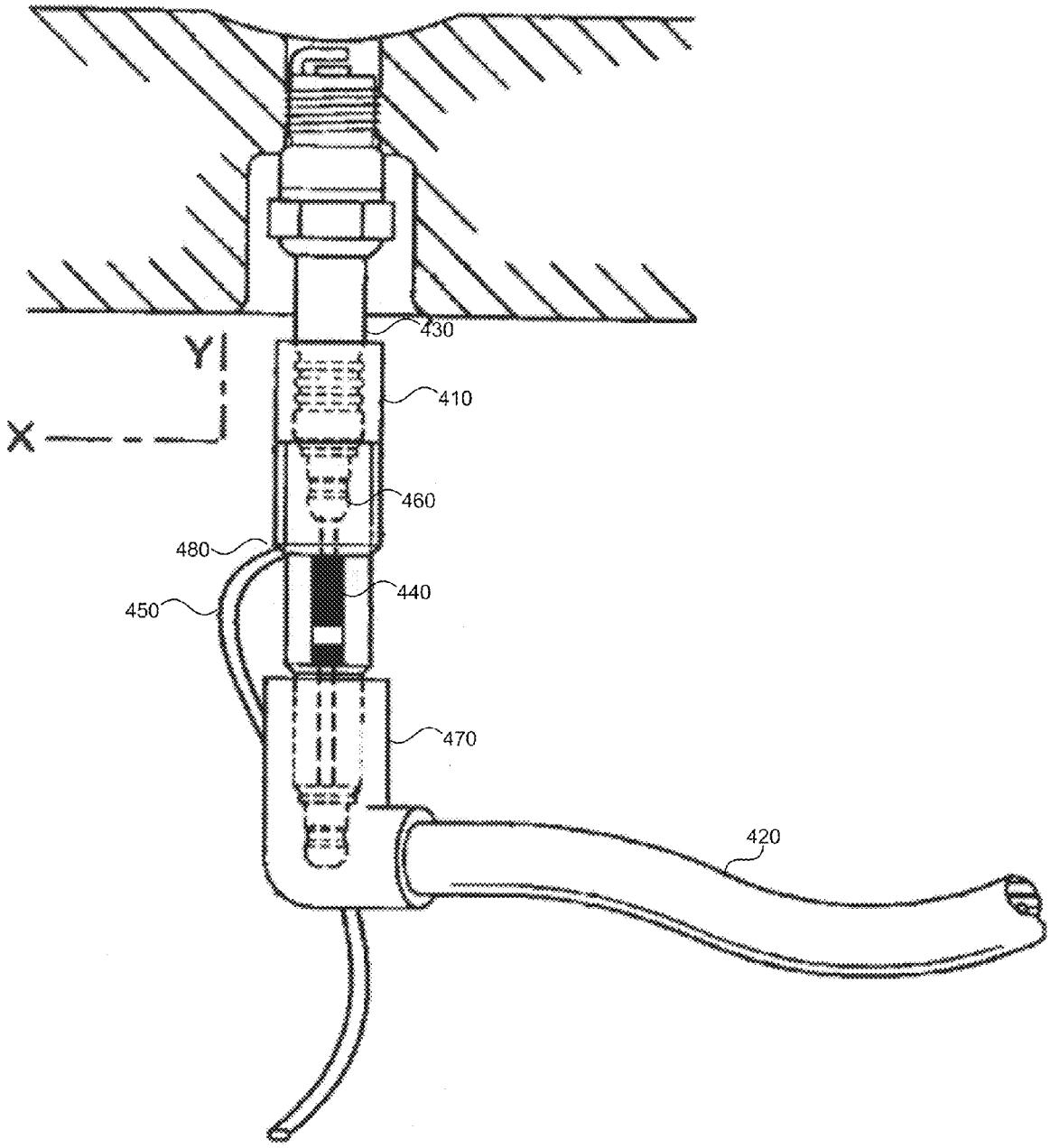
FIG. 4 illustrates a device for applying the plasma ignition system to an existing automotive ignition system, in one embodiment.

FIG. 4 illustrates a device for applying the plasma ignition system to an existing automotive ignition system, in one embodiment. The figure shows a spark plug extender 410 that can be inserted between an existing ignition wire 420 or coil on plug assembly and a spark plug 430. The spark plug extender includes a blocking element 440 and a wire 450 for supplying a secondary current to increase energy across the spark plug 430 gap to create a greater spark through plasma discharge. The wire 450 provides an external follow on current supply to increase the energy of the plasma discharge across the spark gap. The spark plug extender 410 allows the plasma ignition system to be inserted into an existing ignition system. Whereas prior to the system the ignition wire 420 would typically be connected directly to the spark plug 430, the extender 410 allows the plasma ignition system to insert additional electrical circuitry into the ignition process and to control the application of the existing ignition circuitry to the spark plug 430.

The extender 410 includes a slightly elongated body formed of heat resistant and electrically insulating material that extends between a spark plug engagement end 460 and a spark plug wire boot connector end 470. Although particular shapes and arrangements of components are shown for illustration of the concepts described herein, those of ordinary skill in the art will recognize that variations can be made to place the extender in a suitable location for a particular vehicle. For example, some applications may have height limitations or other obstructions that work better with a differently shaped extender 410 than that shown.

The blocking element 440 may include a diode or other circuitry and is located within the body of the extender 410. The blocking element 440 includes a fitting 480 adapted to make an electrical connection to a source of follow on current directly to the spark plug terminal. The blocking element 440 enclosed by the spark plug extender 410 prevents the low-voltage, high-current power supply that provides the follow current from discharging into the conventional capacitive discharge (or other) ignition system. The system may also include a blocking element within the extender 410 or at the other end of wire 450 that prevents current from the conventional ignition system from flowing into the source of follow on current.

In some embodiments, the plasma ignition system reduces the production of oxides of nitrogen that contribute to air pollution. Dilution of the gas mixture, which is most commonly achieved by the use of water mist injection with either excess air (running the engine lean) or exhaust gas recirculation (EGR), reduces the formation of oxides of nitrogen by lowering the combustion temperature. Oxides of nitrogen play a significant role in the formation of smog, and their reduction is one of the continuing challenges for the automotive industry. Dilution of the gas mixture also increases the fuel efficiency by lowering temperature and thus reducing the heat loss through the combustion chamber walls, improving the ratio of specific heats, and by lowering the pumping losses at a partial load. Cyclic variations are caused by unavoidable variations in the local air-to-fuel ratio, temperature, amount of residual gas, and turbulence. The effect of these variations on the cylinder pressure is due largely to their impact on the initial expansion velocity of the flame. This impact can be significantly reduced by providing a spark volume that is appreciably larger than the mean sizes of the in-homogeneities. A decrease in the cyclic variations of the engine combustion process will reduce emissions and increase efficiency, by reducing the number of poor burn cycles, and by extending the operating air fuel ratio range of the engine.

In some embodiments, the plasma ignition system improves cold starts of internal combustion engines. For vehicles used in cold weather, such as cars and snowmobiles, starting the engine is often a problem because cylinders are cold and producing initial combustion is more difficult. The robust spark produced by plasma ionization is particularly helpful for ensuring that combustible material in the engine burns quickly and completely, and can produce a dramatic increase in the likelihood of successful firing of the engine during a cold start. This increases reliability of engines used in cold conditions.

In some embodiments, the plasma ignition system includes components for detecting failure of the plasma generation circuit. Because a traditional spark is sufficient to create ignition of a combustible substance surrounding the spark gap, a failure of the circuitry that produces plasma ionization may initially go undetected and manifest as a slight decrease in efficiency in the engine or increased emissions from a less complete burn of the combustible substance. While this can be handled by traditional means of a routine maintenance schedule (e.g., replacement of parts at a specified interval), it is also useful to detect the condition early so that the engine can operate at higher potential. Thus, the system may include additions to other circuits, such as measurement of oxygen levels through a vehicle oxygen sensor or timing of the capacitor discharge with a microprocessor or other circuit (described further with respect to ionization detection herein), to detect failure of the plasma generation circuit. The system may provide a warning to a user through an ECU (e.g., a check engine light) or other indication that the circuit is not functioning correctly.

Although described herein in the example application of an internal combustion engine, those skilled in the art will recognize numerous other applications for the plasma ignition system. For example, satellites are currently moved in space by the use of plasma thrusters that generate a slight thrust by placing Teflon in an arc between a spark gap. The presence of a spark around the Teflon creates gases that move the satellite in a desired direction. Because the plasma ignition system allows for more efficient generation of plasma ionization around a spark gap, the system allows the movement of satellites using less power and without introducing costly new components. Efficient use of power and reducing component breakdown are often significant considerations for space-bound technology. Numerous other applications are possible, such as toys (the generation of a plasma spark can produce a loud pop powered by a common battery), defibrillators, tasers, and other areas where efficient spark generation is useful.

Ionization Detection

A side effect and benefit of the plasma ignition system described herein is an increased ability to detect ionization activity within the cylinder of an engine by monitoring the capacitor that discharges the follow on current. Typical internal combustion engines fire a spark some amount of time before a piston reaches the top of its stroke. This is usually referred to as the timing of the engine and is expressed as a number of degrees (e.g., typically 15-20 degrees) before top dead center (BTDC) of the piston, where top dead center is the top of the piston's stroke. An earlier timing allows combustion to start before the piston is at the top of the stroke so that combustion is robust during a longer portion of the power stroke of the engine. However, timing that is too early can cause undesirable engine behavior, such as knocking, and in extreme cases counter rotation (firing the piston backwards in the wrong direction) and damage to the engine. For this reason, timing of an engine is often set conservatively by a manufacturer to avoid risk to the engine. However, research in the area of engine monitoring has shown that increased information about ionization inside the cylinder can safely allow more aggressive timing that increases engine performance (adding 50 horsepower to a stock car in one experiment).

Ionization detection operates on the principle that gases in the engine cylinder cause a small current through the spark gap most or all of the time. This current is referred to as ionization current. Because of the connection between the low voltage side of the circuit shown in FIG. 1 and the spark gap, it is possible to introduce monitoring circuitry between the capacitor and the spark gap that allows very precise measurement of the ionization current. In addition, by measuring a rate of discharge of the capacitor it is possible to determine the ionization effectiveness in the cylinder. This information provides a view into what is occurring in the cylinder far greater than is possible today. Combined with the advanced computer control of modern engines, the plasma ignition system can apply the information gathered in a feedback loop to precisely tune the performance of the engine.

In some embodiments, a simple current detection circuit senses the leakage current due to the ions across the spark gap flowing from the same capacitor that produces the spark and enhanced ionization, thus allowing the inference of various conditions and events in the immediate environment of the spark gap such as engine misfire, combustion duration, engine knocking, approximate air/fuel ratio, indications of spark plug fouling, and pre-ignition. This method of plasma ignition with ionization detection is a significant improvement over the state of the art as it can utilize a single capacitor to generate the high voltage energy spark to ignite the fuel as well as supplying additional voltage to generate an ionization current, which allows for miniaturization so the entire circuit can be mounted as a coil on plug ignition system for modern automobiles in a cost effective manner.

The relationship between spark plug gap ionization and engine misfire is well understood in the automotive industry. When the plug sparks, the gases around the plug are ionized and the electrical conductivity within a spark plug gap increases following successful ignition due to the ionization of hot combustion gases. Measuring and analyzing the ionization current provides information about the combustion process. The existence of a sizeable ionization current is known to indicate combustion. Low or zero current is likewise known to indicate a misfire. The occurrence of engine knock, approximate air/fuel ratios, spark plug fouling, and other combustion characteristics can be derived from measurements and analysis of the ionization current.

There exist several types of ionization current detection systems for detecting combustion with ionization current sensing across the spark gap inside the combustion chamber of an internal combustion engine. These systems typically employ two substantially decoupled energy sources where the function of a first energy source is to generate a spark across a spark plug gap and the function of a second energy source includes delivering current to the plug gap and providing a voltage across the plug gap such that an ionization current results and can be detected and measured by a detection circuit. The use of two energy sources employs two high voltage diodes to decouple the ionization circuit from the primary ignition circuit in addition to two DC-DC converters to energize the two decoupled energy sources that are typically capacitors. Such dual capacitor charging circuits are costly given the high expense of the high voltage diodes, DC-DC converters, long lasting metallized film capacitors and additional components that make up the charging circuit for each power source. Furthermore, if one of the diodes breaks down, there will be no ignition in the corresponding cylinder. If any of the components that energize the second energy source fails then ionization sensing and the plasma arc can no longer take place.

In contrast, the plasma ignition system can include an ionization current sensing circuit that is inexpensive to produce, has relatively few components, and produces a smooth current ionization output signal using a single energy source. Coupling between the ionization current sensing circuit and the high voltage spark circuit is minimized by providing a supplemental path that connects the primary discharge side of the capacitor directly to the spark gap that is connected across the secondary windings of the ignition coil or high voltage transformer through a blocking element to ensure one-way flow of current. The single energy source provides energy for a spark across the spark plug gap as it discharges across the primary windings of the transformer. Owing to the high impedance of the primary windings of the ignition coil, the energy source discharges the remainder of its energy across the high voltage spark through the supplemental path that connects the primary discharge side of the single energy source directly to the spark gap through a blocking element, thus causing a high current plasma arc. Subsequent to providing the spark and secondary source of current to the arc, the single energy source is immediately recharged to apply a voltage across the spark gap. This applied voltage results in an ionization current through the spark plug gap. Detection, measurement and analysis of the ionization current alongside data such as ignition trigger time and the cycle the cylinder is in, provides information about the combustion process.

In some embodiments, the circuit of FIG. 1 is modified to provide efficient and economical ionization measurement, while maintaining all of the advantages inherent in a dual energy ignition system or the single energy ignition system of FIG. 1. In some embodiments, the detection circuit includes a resistor through which the ionization current flows at times when the fuel has not been ignited by triggering a high voltage spark. The resulting voltage drop across the resistor provides an ionization signal, indicative of the degree of ionization of the gases in the cylinder, which can be filtered, digitized, and analyzed by a processor to derive combustion characteristics. The processor analyses may be stored for future use, such as historical determination of engine timing. The monitoring circuit may further include a Zener diode that allows the arc current to bypass the resistor in the event of a successful ignition event and allows for greater measurement accuracy and ignition efficiency. Few additional parts are used and accurate measurement is provided.

Figure 5:
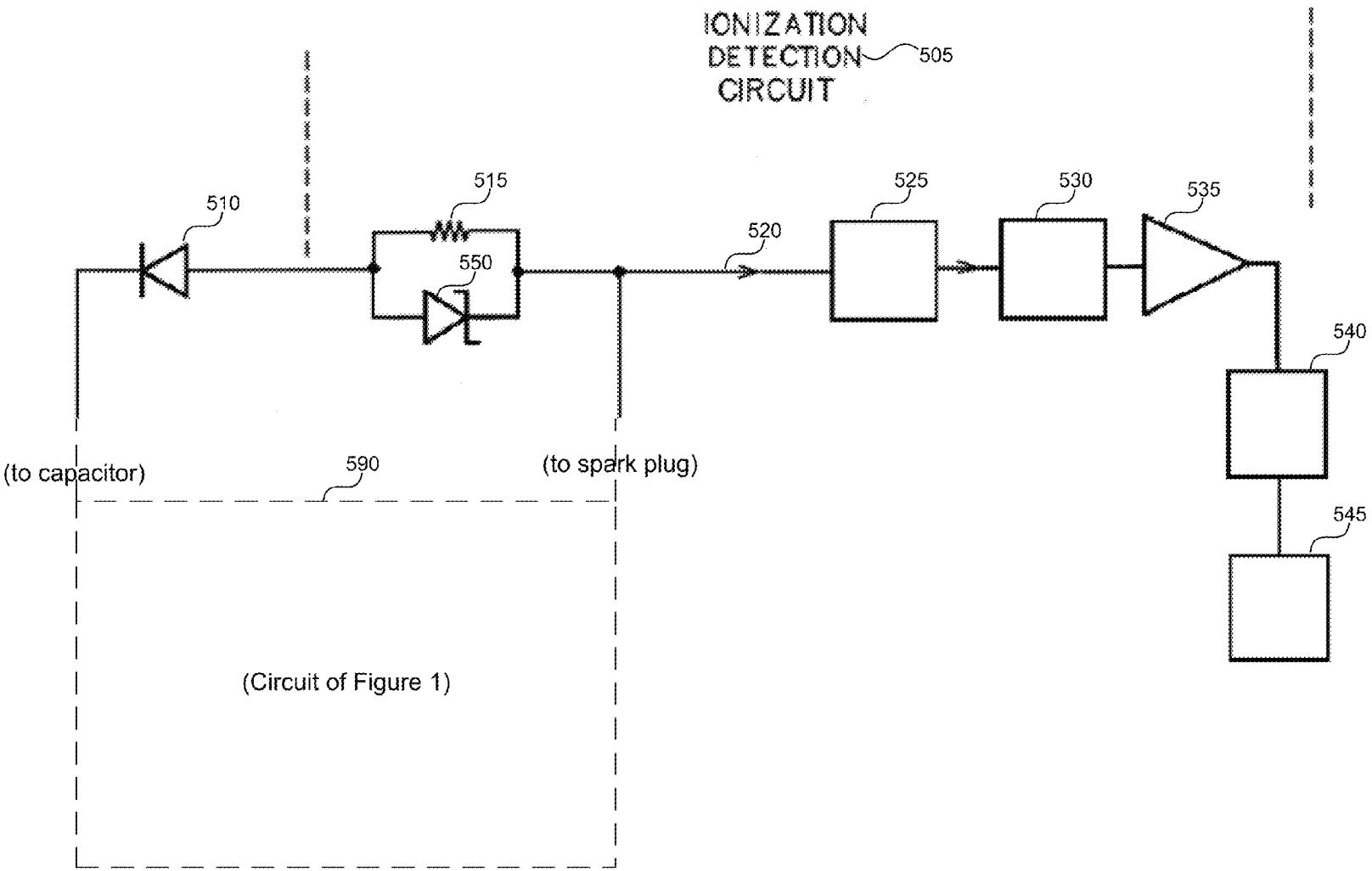
FIG. 5 is a circuit diagram that illustrates a plasma generating circuit with ionization current sensing, in one embodiment.

FIG. 5 is a circuit diagram that illustrates a plasma generating circuit with ionization current sensing, in one embodiment. The figure adds an ionization detection circuit 505 to the circuit 590 of FIG. 1. The blocking element 510 is reproduced from FIG. 1, and the other illustrated components are new to the ionization detection circuit 505. In the illustrated embodiment, at least part of the ionization detection circuit 505 is placed in series with the blocking element 510, allowing the circuit 505 to detect current and voltage changes across the spark gap. The ionization detection circuit 505 utilizes the same energy source as that of FIG. 1 to create and detect the ionization current in the spark gap. The ionization detection circuit 505 utilizes the energy stored in the capacitor of FIG. 1 as the voltage source for the ionization current which in turn travels via resistor 515 thus making this current measurable. The detection circuit 505 comprises a resistor 515, the spark gap, the high-voltage diode 510, and the capacitor. After the spark and the plasma arc occur, the capacitor is quickly re-charged by the primary charging circuit. The energy stored in the re-biased capacitor provides a voltage across the spark gap.

Any current that results is termed the ionization current, and is a function of the ionization levels present around the spark gap in the cylinder. If the current exceeds a certain threshold, then combustion occurred. If the threshold is not reached, then partial combustion or a misfire occurred. The ionization current is measured via the voltage across the resistor 515. This voltage drop provides an ionization signal 520. Problems occur when trying to analyze ionization signal 520 because of noise during charging the capacitor and DC bias across resistor 515 during discharging of the capacitor. Being selective as to when to read the voltage across resistor 515 is a solution to both problems. An analog multiplexer 525 can supply the proper DC bias to a high pass filter 530 most of the time. The analog multiplexer 525 then supplies the ionization signal 520 to the high pass filter 530 during the combustion process. Therefore, the noise and the DC bias are removed from the ionization signal 520 before entering an amplifier 535. Another method of eliminating the noise is to use a low pass filter in addition to or in place of the multiplexer 525. Once amplified by amplifier 535, a signal processor 540 analyzes the ionization signal 520 to determine various characteristics of the combustion process, including detection of misfire. A memory unit 545 stores the analysis data from the processor 540 for future use.

In some embodiments, the ionization detection circuit 505 also includes a Zener diode 550. The Zener diode 550, in parallel with the resistor 515, serves to limit the voltage drop across the resistor 515. Because the arc current is relatively large, accurate measurement of the small ionization bleed current can be difficult. The Zener diode 550 protects the amplifier circuit and allows a higher/more sensitive resistor 515 to be used, thereby providing for better measurement of the ionization signal 520. The Zener diode 550 also avalanches in reverse mode and provides a low impedance path, bypassing resistor 515, for the arc current discharged from the capacitor. This allows efficient operation of the ignition system. Without the Zener diode 550, the arc current would face significant impedance caused by the resistor 515. Reducing circuit impedance increases the peak current and the arc intensity across the spark gap.

The following provides component values for an illustrative embodiment. In this embodiment, a 4.7 μF capacitor is charged to 650 volts by the power source, which includes a 12 volt to 600-volt DC-DC convertor. The trigger circuit includes a 1,000 volt 35 amp SCR. The step-up transformer has a winds ratio of 1:100. A supplemental path is provided directly connecting the primary discharge side of the capacitor to the spark plug gap, through the high-voltage diode 510 rated at 50,000 volts and one amp with a 50-amp surge. A 3.3 volt Zener diode 550 in parallel with a 1 k resistor 515 serves to limit voltage drop across the resistor 515 to 3.3 volts. For the purpose of electromagnetic interference (EMI), shielding is preferably utilized. In addition, components are preferably placed close to the spark plug to shorten the high current, EMI generating discharge path (antenna).

Characteristics of the combustion process can be determined from the ionization signal 520. One simple example is the duration of combustion, which is simply how long the ionization signal 520 exceeds a certain threshold. Another example is engine knock. Engine knock occurs when combustion exceeds the speed of sound. Engine knock is a sound wave in the 5-8 kHz range and can be detected in the ionization signal 520. The processor 540 can be used to isolate and analyze ionization signal waves in the 5-8 kHz range. Presence of such waves indicates that engine knock has occurred. This processor analysis data may also be stored in the memory unit 545. Another example of a combustion process characteristic that can be derived from the ionization signal 520 is the air/fuel ratio. There is a correlation between ionization and air/fuel ratios. The duration of the ionization measurement and the rate of ionization signal 520 decay provide an indication of air/fuel ratio. Therefore, ignition system testing yields a reference curve correlating ionization levels to various air/fuel ratios for particular engine designs. By providing the processor 540 with these correlation data, the processor 540 can analyze the ionization signal 520 and derive an approximate air/fuel ratio. Again, this may be stored for future use in memory unit 545.

Two additional examples of characteristics of combustion determinable from the ionization signal 520 are spark plug fouling and pre-ignition. These characteristics are indicated by the presence of ionization currents during certain engine cycles where combustion is not supposed to occur. In particular, spark plug fouling is indicated when the ionization signal 520 persists for too long. The other characteristic, pre-ignition, occurs when combustion begins before the ignition has fired. Thus, if the ionization signal 520 indicates combustion before sparking has occurred, pre-ignition is indicated. Once again, the manifestation of these characteristics may be stored for future use in memory unit 545. Another useful measurement is engine angular position. Means for providing this data is well known to those skilled in the internal combustion engine art. Engine angular position provides a reference point for processor data derived from the ionization signal 520. For example, when engine knock is detected (via the analyzed ionization signal 520) there is a corresponding engine angular position. If the corresponding engine angular position is also stored in the memory unit 545 along with the engine knock analysis, a technician can later utilize this information for engine repair, adjustment, and the like. An onboard computer or ECU can also use this information to dynamically tune the engine (e.g., by adjusting engine timing).

Similar angular position information corresponding to misfire, combustion duration, engine knocking, air/fuel ratio, and pre-ignition is likewise a useful diagnostic tool. Furthermore, once the engine angular position is determined, the angular position of peak pressure can be approximated because it closely corresponds to the peak of the ionization signal 520. An approximation of the position of peak pressure is very useful for optimizing two engine efficiency parameters. First, in order to generate the greatest torque from a given amount of fuel, the peak pressure in the combustion chamber should occur approximately between 10 and 15 degrees after top dead center (TDC). Second, to lower the temperature of combustion and to lower emissions (e.g., oxides of Nitrogen), the peak pressure should occur after 15 degrees TDC. This allows for the possibility of emissions control using the ionization signal 520.

Coil on Plug Adaptation

In order to provide enhanced ignition performance and limit electromagnetic emissions, modern spark-ignited combustion engines usually employ an ignition coil mounted directly on each of the spark plugs. Various styles of directly mounted ignition coils such as pencil, stick, cigar, plughole, or coil-on-plug are used, eliminating the need for long flexible high voltage leads. While directly mounted ignition coils provide numerous advantages over other types including elimination of high voltage leads that cause EM emissions, elimination of waste spark mode, more precise timing, and packaging benefits, they cannot be easily adapted for dual energy ignition systems for plasma ionization.

The following describes a variation of the plasma ignition system described herein in which a conventional coil on plug assembly is modified to include features of the system described herein. The variation is a coil on plug ignition assembly that includes a housing containing a primary winding, a secondary winding, and a bypass path with a blocking element that connects to an add-on external energy source such as a capacitor charged by a DC-DC converter. In addition, a second blocking element connected to the high voltage secondary output prevents the external energy source from discharging into the secondary winding of the coil on plug assembly. The coil on plug assembly can be integrated with a resin inside a single enclosure to ensure electrical insulation between the parts and to prevent misfires and arcing internal to the assembly.

Previous dual energy ignition systems can only be connected to a distributor-based ignition system with high voltage leads and cannot be used in conjunction with direct coil on plug ignition systems. The adaptation described herein allows application of a single or dual energy plasma-producing ignition system to be in a coil on plug package. This adaptation provides a coil on plug high-energy ignition device that permits simplification of the wiring by incorporating all the blocking elements inside the housing of a coil on plug ignition assembly so a user can connect any external energy source thereby converting a regular single mode ignition system to a high energy dual mode ignition system. The coil on plug ignition assembly provides the advantages of a dual mode ignition system along with the advantages of direct coil-on-plug type ignition coils, and avoids the shortcomings of a distributor-based dual mode ignition system, which can lead to failures because of faulty cables, complicated wiring, EMI/RF interference, diminished energy, and so forth.

Dual energy systems involve the use of blocking elements or diodes to ensure proper operation. The first blocking element (typically rated in kilovolts) ensures one-way flow of current from the dual or second energy source and protects the second energy source from the high voltage output of the ignition coil. The second blocking element (typically rated at a few thousand volts) prevents the second energy source from discharging its energy into the ground path through the secondary windings of the ignition coil. If the second blocking element is not included, the second energy source in a dual energy system will constantly discharge across the secondary windings of the ignition coil resulting failure of the ignition coil due to overheating. Because of the plasma ignition system described herein, dual energy or dual mode ignition systems can now be installed on engines with coil on plug ignition components.

CONCLUSION

From the foregoing, it will be appreciated that specific embodiments of the plasma ignition system have been described herein for purposes of illustration, but that various modifications may be made without deviating from the spirit and scope of the invention. For example, although capacitive discharge ignition (CDI) system components are used in examples herein, those of ordinary skill in the art will recognize the application of the plasma ignition system to other ignition systems, such as transistorized discharge ignition (TDI) systems. Accordingly, the invention is not limited except as by the appended claims.

We claim:

1. An electrical circuit apparatus for producing efficient, enhanced ionization of air surrounding a spark gap in an ignition system, the circuit comprising:

a primary charging circuit configured to charge an energy storage device with a first voltage;

a coil driver circuit configured to discharge the energy storage device into a primary side of a transformer that produces a second voltage at a secondary side sufficient to generate a spark across a spark gap; and an ignition circuit configured to produce a spark across the spark gap, wherein the ignition circuit includes a one-way current path between the energy storage device and the spark gap whereby after generating the spark the energy storage device provides additional current through the spark gap for generating enhanced ionization around the spark gap.

2. The apparatus of claim 1 wherein the primary charging circuit includes a voltage supply, a blocking diode, an inductive element, and a capacitor and wherein the voltage supply, blocking diode, and inductive element charge the capacitor for discharge into the coil driver circuit.

3. The apparatus of claim 1 wherein the coil driver circuit includes a capacitor, a switching device for triggering discharge of the capacitor, the primary side of the high-voltage transformer and a blocking element, wherein the blocking element provides the one-way current path between the capacitor and the spark gap.

4. The apparatus of claim 1 wherein the coil driver circuit includes a silicon-controlled rectifier for triggering discharge of the capacitor, and wherein the silicon-controlled rectifier is triggered by an external signal to discharge the energy storage device.

5. The apparatus of claim 1 wherein the ignition circuit includes the secondary side of the transformer and a spark plug that includes the spark gap, and wherein the one-way current path provides current from a capacitor of the primary charging circuit upon bridging of the spark gap.

6. The apparatus of claim 1 wherein the one-way current path includes a diode that protects the primary charging circuit and coli driver circuit from receiving current from the secondary side of the transformer.

7. The apparatus of claim 1 wherein the energy storage device is charged by the primary charging circuit with a negative voltage.

8. The apparatus of claim 1 wherein the electrical circuit includes multiple coil driver circuits and ignition circuits, one for each cylinder of an internal combustion engine, such that the primary charging circuit provides both a conventional spark and enhanced ionization for each cylinder of the engine.

9. The apparatus of claim 1 wherein the coil driver circuit and ignition circuit are mounted over a spark plug in a coil on plug configuration that reduces a length of transmission of high voltage from the transformer to the spark gap.

10. The apparatus of claim 1 wherein the ignition circuit is further configured to include a radio frequency suppression device attached between the spark gap and the secondary side of the transformer to reduce electromagnetic interference produced by the enhanced ionization.

11. The apparatus of claim 1 wherein the ignition circuit is further configured to include a blocking element between the spark gap and the secondary side of the transformer that prevents current from the energy storing device from flowing through the secondary side of the transformer.

12. The apparatus of claim 1 further comprising a secondary power circuit configured to provide an additional follow on current pulse across the spark gap that causes further ionization around the spark gap.

13. A method for efficiently generating a plasma-based spark in an ignition system, the method comprising:

charging an energy storage device with a charge for creating a spark across a spark gap;

discharging the energy storage device into a high voltage conversion device that converts a first voltage of the energy storage device into a second higher voltage suitable for ionizing air between the spark gap;

producing the spark across the spark gap by generating sufficient voltage at the spark gap to cause one or more electrons to jump across the gap; and directing at least some remaining energy in the energy storage device after producing the spark across the spark gap without passing through the high voltage conversion device to create a current through the spark gap that causes air to ionize and generate a greater spark.

14. The method of claim 13 wherein charging the energy storage device comprises applying power from a power supply to a capacitor that stores charge for discharging into an ignition circuit.

15. The method of claim 13 wherein discharging the energy storage device comprises discharging a capacitor into a high voltage transformer that converts the applied voltage to a higher voltage to create the spark.

16. The method of claim 13 wherein discharging the energy storage device is controlled by a timing device that produces the spark at an appropriate time based on a mechanical state of an engine.

17. The method of claim 13 wherein the spark gap is part of a spark plug with an air gap between electrodes determined to produce an appropriate spark for igniting a combustible substance.

18. The method of claim 13 wherein directing at least some remaining energy across the spark gap comprises connecting a capacitor of the energy storage device to the secondary side of the high voltage conversion device through a diode that allows current to flow across the spark gap once the initial spark has turned the spark gap from an open circuit to a completed circuit across which current can more easily flow.

19. The method of claim 13 further comprising preventing a reverse flow of current from the high voltage conversion device from flowing through the energy storage device.

* * * * *